United States Patent [19]

Hudson

[11] 4,175,747

[45] Nov. 27, 1979

[54] LIGHT PROJECTOR SHOOTING APPARATUS WITH MOVABLE, PERFORABLE, TARGET SUPPORT

[75] Inventor: Robert H. Hudson, Seekonk, Mass.

[73] Assignee: Les Jouets Educatifs Universels, Drancy, France

[21] Appl. No.: 828,954

[22] Filed: Aug. 29, 1977

[30] Foreign Application Priority Data

Aug. 31, 1976 [FR] France ..... 76 26269

[51] Int. Cl.[2] ..... A63F 9/02; F41J 9/00

[52] U.S. Cl. ..... 273/101.2; 273/105.1

[58] Field of Search ..... 273/101.2, 105.1, 105.6, 273/105.2; 46/195

[56] References Cited

U.S. PATENT DOCUMENTS

| | | | |
|---|---|---|---|
| 1,240,990 | 9/1917 | Lefever | 46/195 |
| 2,098,873 | 11/1937 | Kuppenbender et al. | 273/101.2 |
| 2,161,172 | 6/1939 | Kassler | 273/101.2 |
| 2,269,410 | 1/1942 | New | 273/101.2 |
| 2,449,030 | 9/1948 | Wilsey | 273/105.1 |
| 3,858,884 | 1/1975 | Cassagnes | 273/101.2 |

FOREIGN PATENT DOCUMENTS

| | | | |
|---|---|---|---|
| 1163194 | 2/1964 | Fed. Rep. of Germany | 273/105.6 |
| 2304052 | 12/1976 | Fed. Rep. of Germany | 273/105.6 |
| 731986 | 7/1932 | France | 273/101.2 |

*Primary Examiner*—Richard C. Pinkham
*Assistant Examiner*—Lawrence E. Anderson
*Attorney, Agent, or Firm*—Blanchard, Flynn, Thiel, Boutell & Tanis

[57] ABSTRACT

This shooting game or apparatus includes a light projector having a source of light, an objective and a sighting device in which is placed, in an interchangeable manner, a perforable support bearing some targets. The support is caused to move through the light beam between the source of light and the objective so as to project the image of a target on a screen. Hammer apparatus is movably mounted on the projector for driving a tapered element so as to perforate the support at a point somewhere on its surface. The apparatus also includes apparatus for causing the perforable support bearing the targets to move continuously through the light beam.

1 Claim, 3 Drawing Figures

LIGHT PROJECTOR SHOOTING APPARATUS WITH MOVABLE, PERFORABLE, TARGET SUPPORT

This invention relates to a shooting game or apparatus, and more particularly to a light projector having a source of light, a lens and a sighting device through which a perforable support bearing some targets is caused to move between the source of light and the lens in order to project the image of a target on a screen.

An apparatus similar to the one described herein is disclosed in U.S. Pat. No. 3,858,884, issued Jan. 7, 1975 and entitled: "Simulated Shooting Apparatus Including a Transparent Striking Member".

The feature of this prior apparatus consists of causing holes to be made in a tape at points determined by the target which is visible in projection on the screen. In order to effect a shooting operation, the player must in fact see a point determined by this target by moving the pistol until the image of a tapered element coincides with the sighted point, after which it rests on a small catch so that the tapered element comes to perforate the support tape exactly at the place corresponding to the position of its image on the screen. The perforation thus realized is shown immediately on the screen on one spot, that which permits the quality of the firing to be appreciated instantaneously. Such an action involves a perforable support resting immovably all during the firing, so that the player can take his time in effecting each sighting.

The present invention is designed to make this game yet more attractive by obliging the player to effect his sightings more rapidly. In order to do this, it has for its object an apparatus for perfected firing which is characterized in that it involves means for making the perforable support carrying the targets move continuously.

Thus when these means are actuated, the player is obliged to effect his sightings rapidly if he wishes to hit the perforations on selected points of the target on which he sees the image displaced regularly on the screen. Further, he must show much more skill in order to hit the targets with great precision. Thus it is conceived that the attraction of the apparatus is improved.

Preferably, the means for making the perforable support move continuously are constituted by a mechanical or spring motor located in a removable unit fixed on the exterior wall of the projector, on a level with the sighting device.

Such a motor has the advantage of being cheap, and of being able to function practically without maintenance with the minimum of risk of motor trouble.

It will be noted that the unit of the light projector is so designed that one can prevent the operation of the motor which can be desirable when the apparatus is operated by small children.

According to a preferred embodiment of the invention, the motor is provided with a shaft extending through the exterior of the unit and supporting at the free end thereof a driving pulley. A pressure pulley being susceptible of cooperating with the driving pulley in such a way that during the functioning of the motor, the perforable support, previously inserted between the two pulleys can be driven continuously through the sighting device.

It will be noted that, according to this form of embodiment, the pressure pulley is carried by an axle supported at one of the extremities of a bent lever mounted within a unit in such a way as to be able to pivot between an active position in which it applies the pressure pulley against the driving pulley and an inactive position in which the pressure pulley pulls away from the driving pulley. The bent lever is urged into its active position by means of a leaf spring acting on the lever in the neighborhood of the axle of the pressure pulley. The pressure pulley can be moved into its inactive position by pivoting the bent lever against the force of the spring.

Thus, by engaging and pivoting the lever with the aid of a finger, the player can bring the bent lever into its inactive position, that which, for example, permits him to remove the perforable support from between the two pulleys and to modify the position of the latter in the sighting device.

One form of execution of the present invention is described hereafter by way of example, with reference to the attached drawings in which.

Figure 1:
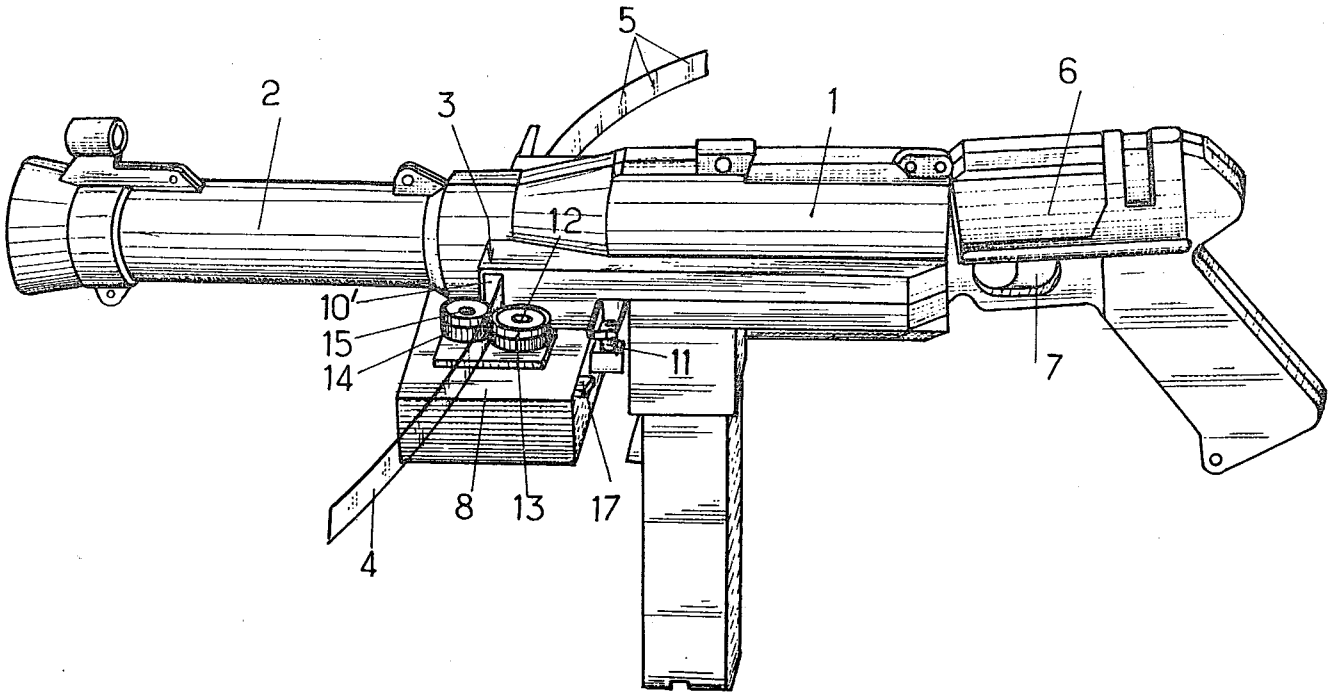
FIG. 1 is a perspective view of a shooting apparatus conforming to the invention.

The shooting game or apparatus illustrated in FIG. 1 involves a light projector or gun of which the body 1 includes among other things a non-visible objective which is placed slightly behind a cylindrical hollow part 2 situated in front of body 1. A sighting device 3 permits placement of a perforable support 4 bearing some targets 5 in an interchangeable manner, between a source of light, likewise nonvisible, and said objective. Further, the projector includes a hammer means 6 mounted in a movable manner with respect to the body of the projector and driven by the operation of the trigger 7 to cause a tapered element to perforate the support 4 at a point somewhere on its surface.

In fact, the internal structure of this projector is practically the same as the corresponding structure disclosed in said U.S. Pat. No. 3,858,884 and, thus, does not need to be described in further detail herein.

Conforming with the present invention, the perforable support 4 is susceptible to being driven in such a way as to unthread continuously through the interior of the sighting device. For this effect, a removable unit 8 containing a mechanical or spring motor 9 is fixed on the exterior wall of the body 1, slightly below the opening 10' in the sighting device, with the help of such screws as that represented at 11 in FIG. 2.

Figure 2:
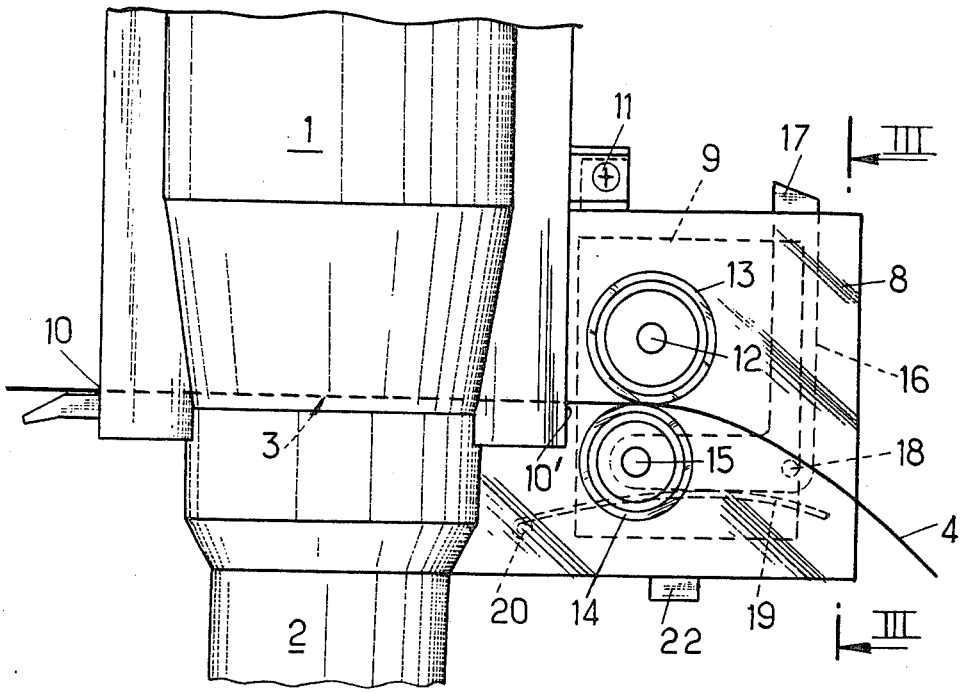
FIG. 2 is an enlarged top view of a fragment of the shooting apparatus.
Figure 3:
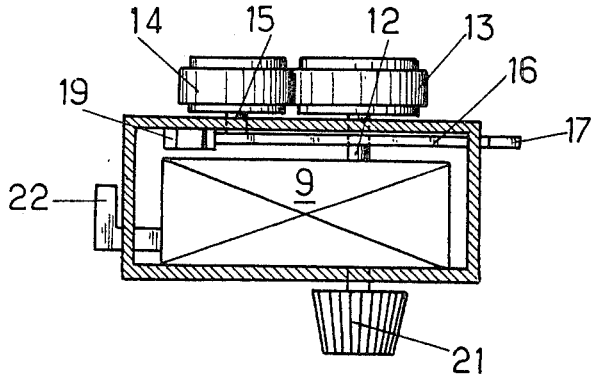
FIG. 3 is a sectional view taken along line III—III in FIG. 2.

As is shown particularly well in FIGS. 2 and 3, the motor 9 is provided with a driving shaft 12 which extends through the upper wall of the unit 8 and carries on its free end a driving pulley 13.

A pressure pulley 14, arranged to cooperate with the pulley 13, is mounted on an axle 15 carried by that extremity of a bent lever 16 which is situated in the interior of the unit 8. This bent lever is provided at its other extremity with a push button 17 which projects through and beyond a longitudinal opening in the lateral rear wall of the unit. Said lever 16 is susceptible to pivoting around an axis 18. It can in fact pivot between an active position in which it applies the pressure pulley against the driving pulley and an inactive position in which it is spaced from the driving pulley.

A thin, resiliently flexible strip or spring is placed in the interior of the unit and fixed at one of its extremities to the unit 8 by a vertical pin 20. The spring presses against the part of the bent lever which carries the axle 15 of the pressure pulley. The bent lever is thus continuously urged into its active position. It is understood, of course, that movement of the push button 17 against the counteraction exerted by the spring 19 will cause the bent lever to move into its inactive position.

Referring more particularly to FIG. 3, it will be noticed in addition that the motor 9 can be rewound by means of a rewind knob 21 which projects below the lower wall of the unit 8, and being started or stopped with the help of push button 22 situated on the side wall of said unit 8.

Referring again to FIG. 1, it will be noticed finally that in the particular embodiment envisioned here, the contact points of the pulleys 13 and 14 are situated in the path of the support 4 as it departs the opening 10 in the sighting device 3.

After having fixed the unit 8 on the body of the projector and closed the circuit of the source of light, the projector is used in the following manner.

First the perforable support 4 is introduced through the sighting device 3 threading progressively in through the opening 10 and then out through the opening 10', which openings are on opposite sides of the sighting device. The rewind knob 21 is turned which energizes the spring motor 9. It is noted that during this operation the pulleys 13 and 14 rotate in the reverse direction. Finally, when one estimates that the spring is sufficiently wound, one actuates the push button 17 to move the pressure pulley 13 away from the driving pulley 14. The support 4 can then be inserted between the two pulleys; the push button 17 is then released. One now maneuvers the push button 22 for commanding the forward thrust of the motor. Driven by the pulley, the support 4 is thus displaced across the sighter and one can begin, upon operating the light switch and trigger, the firing into the targets which move by continuously.

One easily conceives that the firing conforming to the invention is attractive since the player is obliged to effect these firings very rapidly if he wishes to hit a determined target.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A shooting apparatus involving, in combination, a light projector having a source of light, an objective and a sighting device permitting placement in an interchangeable manner a perforable support carrying some targets through the light beam between the source of light and the objective in order to project the image of a target on a screen, and a member with hammer of a pistol type mounted in a movable manner with respect to the projector and driving by the means of said hammer a tapered element susceptible of perforating the support at a point somewhere on its surface: characterized in that the projector includes means for threading the perforable support bearing the targets to pass through said light beam continuously, the means for threading continuously the perforable support comprising a spring motor provided within a removable unit fixed on the exterior wall of the projector at the level of the sighting device, the motor being provided with a shaft extending through the wall of the unit and supporting at the free end thereof a driving pulley; a pressure pulley being susceptible to cooperate with the driving pulley in such a way that, during the functioning of the motor, the perforable support, previously inserted between the two pulleys, is driven continuously through the sighting device; the pressure pulley being carried by an axle provided on one of the extremities of a bent lever mounted within the unit in such a way as to be able to pivot between an active position in which it applies the pressure pulley against the driving pulley and an inactive position in which the pressure pulley is spaced from the driving pulley slightly, the lever being maintained in its active position under the influence of a leaf spring pushing on it in the neighborhood of the axle of the pressure pulley and being susceptible of being brought into its inactive position by pivoting said lever against the counter action exerted by the spring.

* * * * *